US005937119A

United States Patent [19]

Harting et al.

[11] Patent Number: 5,937,119

[45] Date of Patent: Aug. 10, 1999

[54] LINE BRANCHING DEVICE FOR BRANCHING A CONDUCTOR STRING

[75] Inventors: Dietmar Harting, Espelkamp; Ralf Bokamper, Lubbecke; Frank Ostsieker, Kirchlengern; Dirk Oberhokamp, Herford, all of Germany

[73] Assignee: Harting KGaA, Espelkamp, Germany

[21] Appl. No.: 08/890,475

[22] Filed: Jul. 9, 1997

[30] Foreign Application Priority Data

Jul. 26, 1996 [DE] Germany ..... 196 30 202

[51] Int. Cl.[6] ..... G02B 6/26

[52] U.S. Cl. ..... 385/44; 385/39; 385/42

[58] Field of Search ..... 385/44, 39, 41, 385/42, 43, 45, 47, 10, 15

[56] References Cited

U.S. PATENT DOCUMENTS 4,103,154 7/1978 D'Auria et al. ..... 385/44 X
4,234,760 11/1980 Lawson .
5,666,448 9/1997 Schoenwald et al. ..... 385/44
5,757,994 5/1998 Schoenwald et al. ..... 385/44

FOREIGN PATENT DOCUMENTS 92 17 344 4/1993 Germany .
295 01 970 U 1 7/1996 Germany .

*Primary Examiner*—Phan T. H. Palmer
*Attorney, Agent, or Firm*—Dorn, McEachran, Jambor & Keating

[57] ABSTRACT

For a line branching device for branching a conductor string it is proposed that an approximately T-shaped housing be provided and the conductor string be guided uninterruptedly through the upper crosspiece of the T-shaped. At the base of the T there is provided a plug terminal whose contacts are permanently connected to the conductors of the conductor string and via which a consumer can be connected.

16 Claims, 2 Drawing Sheets

LINE BRANCHING DEVICE FOR BRANCHING A CONDUCTOR STRING

FIELD OF THE INVENTION

The invention relates to a line branching device for branching a conductor string.

Such line branching devices are used to connect electric consumers in networked electrical systems wherein a conductor string is provided for supplying the consumers with the necessary electric power and the consumers are connected electrically in parallel to the conductor string. The actuation of the consumers, i.e. the choice as to which consumer is to be connected, takes place via a signal bus system.

It is known to run the conductor string across connection sockets of the consumers, in which case the conductor string is virtually looped through these connection sockets. In the event of the breakdown of a consumer and the necessary replacement thereof, the conductors must be separated and following consumers are then cut off from the conductor string at least temporarily. However, the replacement of a defective consumer or connection of a new consumer is also relatively costly and wiring and connection faults can also easily arise.

The object of the invention is to provide a line branching device which simplifies the connection of new consumers and the replacement of a consumer.

This object is fulfilled in that the line branching device comprises a housing through which the conductor string is looped with the interposition of a substantially T-shaped wiring structure, that a plug terminal is provided on one side of the housing, and that the conductors of the conductor string are connected to one another via the wiring structure and the contacts of the plug terminal are connected to the conductors of the conductor string.

Advantageous developments of the invention are described in claims 2 to 20.

The advantages attained by the invention consist in particular in that the conductor string is looped uninterruptedly through the line branching device and that the reconnection or replacement of a consumer takes place via a simple plug terminal, it being unnecessary to interrupt the conductor string.

An exemplary embodiment of the invention is illustrated in the drawing and will be explained in detail in the following. In the drawing:

DESCRIPTION OF THE PREFERRED EMBODIMENT

Figure 1:
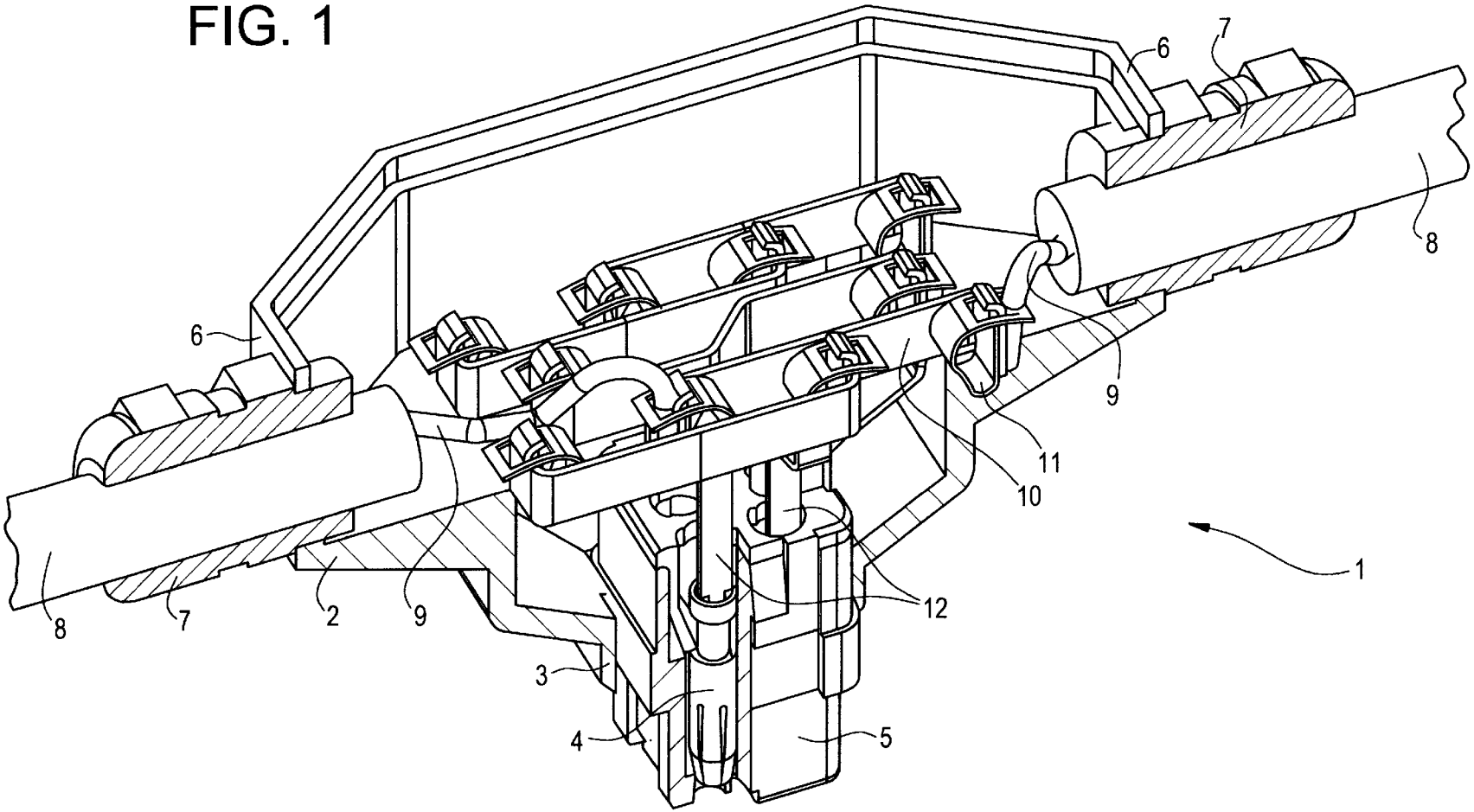
FIG. 1 illustrates a line branching device.

The line branching device illustrated in FIG. 1 substantially comprises a T-shaped housing 1 having an upper crosspiece 2 and a base 3. A plug terminal 5 provided with plug contacts 4 is arranged on the base. Here this plug terminal has the form of a plug terminal known per se, so that commercially available plug connectors can be plugged therein.

PG screw couplings 7, through which the ends of a conductor string 8 lead into the housing, are provided on both sides 6 of the crosspiece. The individual conductors 9 of the conductor string or cable are connected to one another via busbars 10. Preferably the connections of the conductors to the busbars are formed by cage tension springs 11. The busbars also comprise an integral part 12 which in each case faces towards an assigned contact 4 of the plug terminal and whose end is connected to the contact.

The wiring structure within the housing 1 is substantially T-shaped. Therefore although a T-shaped housing is preferably provided, this is not essential and the housing can optionally also have a different geometric formation.

Optionally it can be provided that multipolar plug devices are also provided on the sides 6 of the housing 1 and that the conductor string is connected thereto by means of plugs. The ends of the contact elements of the plug devices facing towards the interior of the housing 1 then are connected to one another via the busbars 10.

Figure 2:
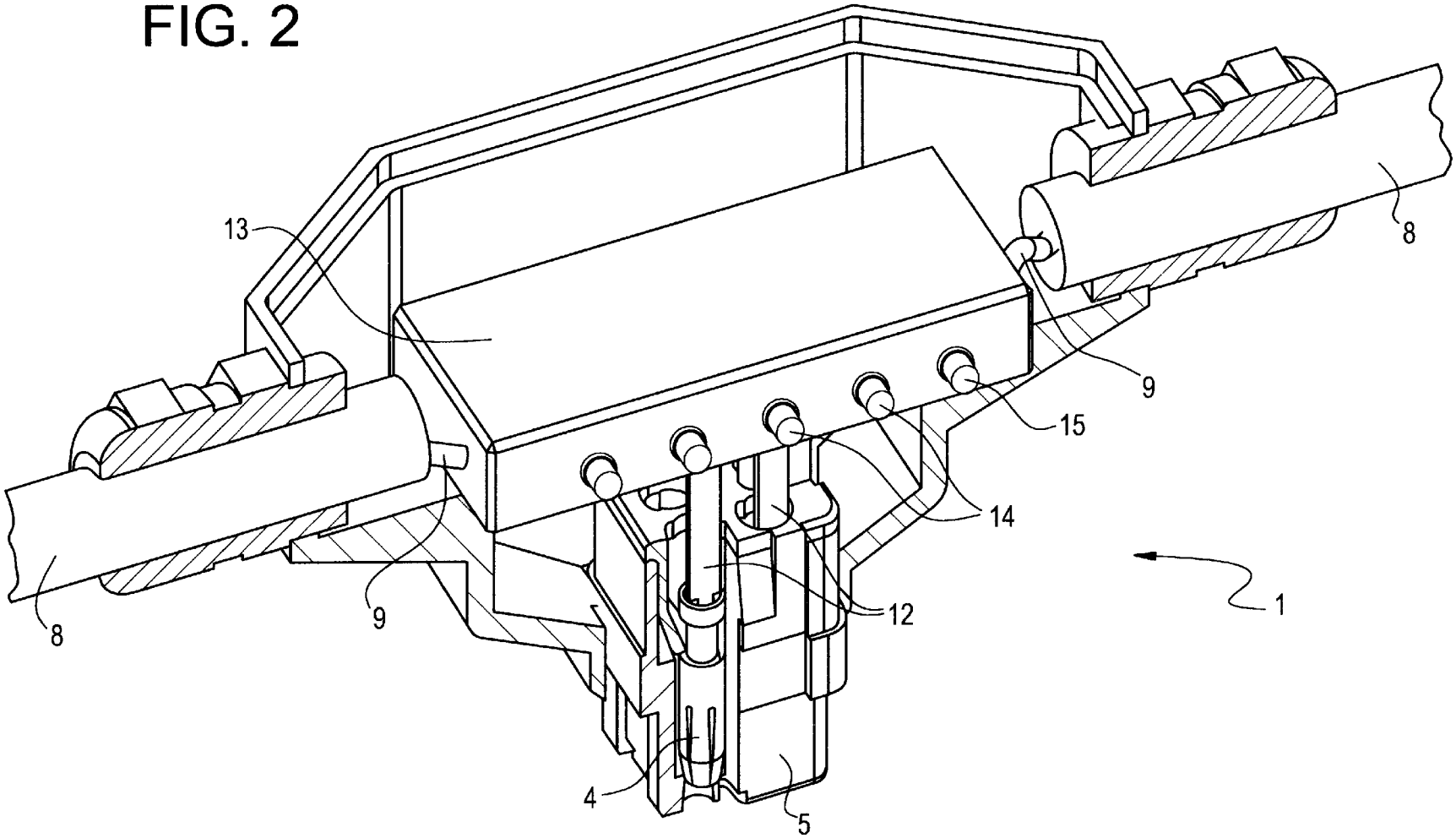
FIG. 2 illustrates a line branching device with integrated electronic circuit.

FIG. 2 illustrates a further development of the line branching device wherein in the housing 1 an electronic circuit 13 is provided across which the conductors 9 of the conductor string extend, the conductors being directly through-connected. Between the terminals of the contact elements 4 of the plug terminal 5 are arranged switching means which have not been shown in detail here and by means of which the consumer connected to the plug terminal can be switched. The switching means are driven via separate control lines or via control lines provided in addition to the conductors 9 in the cable of the conductor string.

The electronic circuit can also be provided with luminescent displays 14, such as for example LEDs, and with keys or switches 15 which are visible and accessible from the exterior of the housing. Here the luminescent displays provide an operational or status display of the connected consumer and the keys or switches can serve to reset or influence the logic stage of the electronic circuit in the event of a disturbance.

It can also be provided that the signals for driving the switching means are modulated onto the conductors 9 of the conductor string which transmit the electric power. In this case the electronic circuit comprises a logic stage for detection and decoding which serves to detect the control signals and drives the switching means in an appropriate fashion.

To prevent the control signals from being influenced by interference signals superimposed upon the conductors 9 of the conductor string, it can also be provided that the control signals are fed into the housing 1 as optical signals via optical waveguides. Then an appropriate device is provided in the electronic circuit 13 for the conversion of the optical signals into electrical signals for driving the switching means.

Finally the housing 1 can also be designed to be impervious to electromagnetic energy in order on the one hand to prevent the switching means from being influenced by external interference signals and on the other hand to prevent the emission of interference signals from the housing upon the switching of the switching means.

We claim:

1. A line branching device for branching a conductor string, characterized in that the line branching device comprises a housing (1) through which a conductor string (8) is looped with the interposition of a substantially T-shaped wiring structure, a plug terminal (5) is provided on one side of the housing and the conductors of the conductor string are connected to one another via the wiring structure and the contacts (4) of the plug terminal (5) are connected to the conductors (9) of the conductor string, the conductors (9) of the conductor string (8) are guided within the housing (1) via busbars (10) to whose ends they are in each case electrically connected by conductor terminals formed as cage tension springs (11), the busbars 10 are in each case connected to a contact (4) of the plug terminal (5).

2. A line branching device according to claim 1, characterised in that the conductor string (8) leads into the housing on one side thereof and leads out of the housing on the other side thereof.

3. A line branching device according to claim 2, characterised in that the housing (1) is substantially T-shaped, the conductor string (8) leads into the housing (1) on one side of the crosspiece (2) of the T and leads out of the housing on the other side of the crosspiece and the plug terminal (5) is provided on the base (3) of the T.

4. A line branching device according to claim 3, characterized in that the inlets and outlets of the conductor string (8) have the form of multi-polar plug terminals.

5. A line branching device according to claim 4, characterised in that the multipolar plug devices are arranged on the sides (6) of the upper crosspiece (2) of the T-shaped.

6. A line branching device according to claim 1, characterized in that the inlet and outlet of the conductor string (8) have the form of PG screw couplings (7).

7. A line branching device for branching a conductor string, characterized in that the line branching device comprises a housing (1) through which a conductor string (8) is looped with the interposition of a substantially T-shaped wiring structure, a plug terminal (5) is provided on one side of the housing and the conductors of the conductor string are connected to one another via the wiring structure and the contacts (4) of the plug terminal (5) are connected to the conductors (9) of the conductor string, an electronic circuit (13) is provided in the housing (1), across which electronic circuit (13) the connections between the conductors (9) of the conductor string and the terminals of the plug terminal (5) are guided in switchable fashion.

8. A line branching device according to claim 7, characterised in that the cable of the conductor string (8) is formed by a hybrid cable which, in addition to the power-transmitting conductors, also contains control lines and the electronic circuit (13) can be driven via these control lines.

9. A line branching device according to claim 8, characterised in that the control lines extend electrically uninterruptedly through the housing, drive lines of the electronic circuit (13) being connected to the control lines.

10. A line branching device according to claim 9, characterised in that the control lines extend electrically uninterruptedly through the housing (1), the drive lines of the electronic circuit being connected to the control lines.

11. A line branching device according to claim 10, characterised in that the control lines lead into the housing (1) at outer surfaces thereof, the inlet and outlet having the form of a so-called PG screw coupling or plug connection.

12. A line branching device according to one of claim 11, characterised in that the control line has the form of an optical waveguide cable.

13. A line branching device according to claim 12, characterised in that when the control line has the form of an optical waveguide cable, the conversion of the optical signals into electrical signals is integrated in the electronic circuit (13).

14. A line branching device according to claim 7, characterised in that the driving of the electronic circuit (13) takes place via control signals modulated onto the conductors (9) of the conductor string (8).

15. A line branching device according to claim 7, characterised in that display and control elements (14, 15) are provided on or in the housing (1).

16. A line branching device according to claim 7, characterised in that the housing (1) is designed to be impervious to electromagnetic energy.

* * * * *